US006259799B1

(12) United States Patent
Suzuki et al.

(10) Patent No.: US 6,259,799 B1
(45) Date of Patent: Jul. 10, 2001

(54) SPEAKER SYSTEM

(75) Inventors: Seiki Suzuki; Noboru Kyouno, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/060,711

(22) Filed: Apr. 16, 1998

(30) Foreign Application Priority Data

Nov. 11, 1997 (JP) ..... 9-308718

(51) Int. Cl.[7] ..... H04R 1/00; H04R 1/02; H04R 3/00

(52) U.S. Cl. ..... 381/401; 381/335; 381/111; 381/182; 381/402

(58) Field of Search ..... 381/182, 99, 400, 381/401, 89, 332, 333, 334, 335, 336, 59, 186, 111, 117

(56) References Cited

U.S. PATENT DOCUMENTS 3,665,124 * 5/1972 Sotome ..... 179/115.5
3,838,216 * 9/1974 Watkins ..... 179/1
3,984,635 * 10/1976 Nsetorovic et al. ..... 179/1
4,504,704 * 3/1985 Ohyaba et al. ..... 179/115.5
5,117,459 * 5/1992 McShane ..... 381/24
5,828,767 * 10/1998 Button ..... 381/195

FOREIGN PATENT DOCUMENTS 56-54195 5/1981 (JP) .

OTHER PUBLICATIONS

Dickson, Vance "Loudspeaker Design Cookbook", p.30, 1991.*

* cited by examiner

*Primary Examiner*—Xu Mei

(57) ABSTRACT

A speaker system includes a plurality of double-voice-coil speaker units fitted to a closed type cabinet and connected in parallel with each other so that first voice coils are connected to each other at the same polarities, and second voice coils are connected to each other at the same polarities, and a single impedance compensating circuit is connected in series to the second voice coils for making the input impedance as the speaker system constant.

2 Claims, 5 Drawing Sheets

SPEAKER SYSTEM

BACKGROUND OF THE INVENTION

1. Field of the Invention

The present invention relates to a speaker system having a plurality of double-voice-coil speaker units, a closed type cabinet, and an impedance compensating circuit for making the resistance of an input impedance constant.

2. Description of the Related Art

FIG. 5 shows a structural example of a conventional speaker disclosed by Watkins (W. H. Watkins, "New Loudspeaker with Extended Bass," Audio, Dec. 1974, pp.38–46) which is designed to improve a sound radiation efficiency in a low sound region by using double voice coils. In FIG. 5, reference numeral 100 denotes a signal input terminal to a speaker; 10, an impedance compensating circuit made up of a series circuit consisting of an inductance L and a capacitance C for making the resistance of an electric impedance of the speaker constant; 20, a double-voice-coil speaker unit; 21, a first voice coil; 22, a second voice coil; and 25, a bobbin for fixing those voice coils 21 and 22.

In general, in the case where there is no impedance compensating circuit 10, that is, in the case where only the first voice coil 21 is used, the electric impedance of the speaker unit 20 forms a parallel resonance circuit so that a characteristic peak occurs in the vicinity of a minimum resonance frequency $f_0$ of the speaker unit as shown in FIG. 6. For that reason, a current that flows in the first voice coil 21 is reduced in the vicinity of the resonance frequency $f_0$, to thereby reduce the efficiency of a sound radiated from the speaker.

Therefore, in FIG. 5, an impedance compensating circuit 10 made up of a series circuit consisting of an inductance L and a capacitance C is added in series to the second voice coil 22 in such a manner that a series resonance circuit having a resistance provided by the second voice coil 22 is connected in parallel with the first voice coil 21, thereby making the electric impedance constant at all times (making the resistance constant) to improve the sound radiation efficiency.

FIG. 7 shows a change in sound pressure level in a low sound region due to the presence/absence of the impedance compensating circuit 10.

As is apparent from FIG. 7, a rise of the sound pressure level, that is, a rise of the sound radiation efficiency is found in the vicinity of the minimum resonance frequency $f_0$ with making the resistance of the impedance constant using the impedance compensating circuit 10. The effect reaches to the extent that the sound pressure level reaches several dB, depending on the conditions.

FIG. 8 shows a system extended from the conventional speaker structure shown in FIG. 5, in which a plurality of double-voice-coil units are used.

In FIG. 8, reference numeral 10-1, . . . , 10-i, . . . , 10-n denote impedance compensating circuits; 20-1, . . . , 20-i, . . . , 20-n, double-voice-coil speaker units; 21-1, . . . , 21-i, . . . , 21-n, first voice coils; 22-1, . . . ,22-i, . . . , 22-n, second voice coils; and 25-1, . . . , 25-i, . . . ,25-n, bobbins for fixing the voice coils. The same or like parts as those in FIG. 5 are indicated by the identical references.

By the way, in order to realize the low resistance in the conventional speaker structure, there is required one impedance compensating circuit for each double-voice-coil unit. To satisfy the above requirement, an impedance compensating circuit corresponding to each speaker unit is required in FIG. 8.

As shown in FIG. 8, in the case where a plurality of speaker units are used, an impedance compensating circuit is required in correspondence with each unit in the conventional speaker structure. Therefore, in the speaker system using a plurality of units, there are required a plurality of impedance compensating circuits. As a result, such a speaker unit is generally expensive, and an interior of the cabinet is occupied by those plural impedance compensating circuits from the spacial viewpoint, resulting in a problem that a volume necessary for low-sound reproduction cannot sufficiently be ensured.

SUMMARY OF THE INVENTION

The present invention has been made to solve the above drawbacks in the conventional example, and therefore an object of the present invention is to provide a closed type speaker system which is capable of making a resistance of an electric impedance constant with one impedance compensating circuit, even in the case where a plurality of double coil units are used.

In order to achieve the above object, according to the present invention, there is provided a speaker system comprising: a closed type cabinet in which a rear space with respect to a speaker disposed face is closed; a plurality of double-voice-coil speaker units of the same specification each having a first and a second voice coils and being fixed to said closed type cabinet; and an impedance compensating circuit that makes the resistance of an electric impedance of the speaker system constant; wherein the first voice coils are connected in parallel to each other so that the respective same polarities are connected to each other, the second voice coils are connected in parallel to each other so that the respective same polarities are connected to each other, an input signal is directly applied to the respective first voice coils, and the input signal is applied to the respective second voice coils through the impedance compensating circuit.

Also, the impedance compensating circuit is made up of a series circuit that includes an inductance and a capacitance.

Further, the double-voice-coil speaker unit is characterized in that a resistance $R_{v2}$ of the second voice coils and element constants L, C of the impedance compensating circuit satisfy the following expressions, assuming that a resonance angular frequency viewed from the first voice coil is $\omega_0$, an equivalent mass is $m_0$, a compliance is $C_0$, an electric sharpness is $Q_0$, a mechanical sharpness is $Q_m$, a ratio of the force factor of the second voice coil to the first voice coil is $\alpha$, an air compliance due to a volume within the closed type cabinet viewed from a single unit as disposed is $C_b$, a mechanical resistance is $r_b$, an inductance of the impedance compensating circuit is L, a capacitance is C, the resistances of the first and second voice coils are $R_{v1}$ and $R_{v2}$, respectively, and the number of the double-voice-coil speaker units as used is n, under the condition where the second voice coils are opened:

$$R_{V2} = R_{V1}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\};$$

$$L = \frac{R_{V1}}{\omega_0}\left(\frac{Q_0 Q_m}{Q_m - Q_0}\right); \text{ and}$$

$$C = \frac{1}{R_{V1}\omega_0}\left(\frac{Q_m - Q_0}{Q_0 Q_m}\right)\frac{\gamma_b}{n + \gamma_b}, \text{ where}$$

$$\gamma_b = \frac{C_b}{C_0} \text{ and } Q_b = \frac{\omega_0 m_0}{r_b}.$$

BRIEF DESCRIPTION OF THE DRAWINGS

These and other objects, features and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings.

Figure 1:
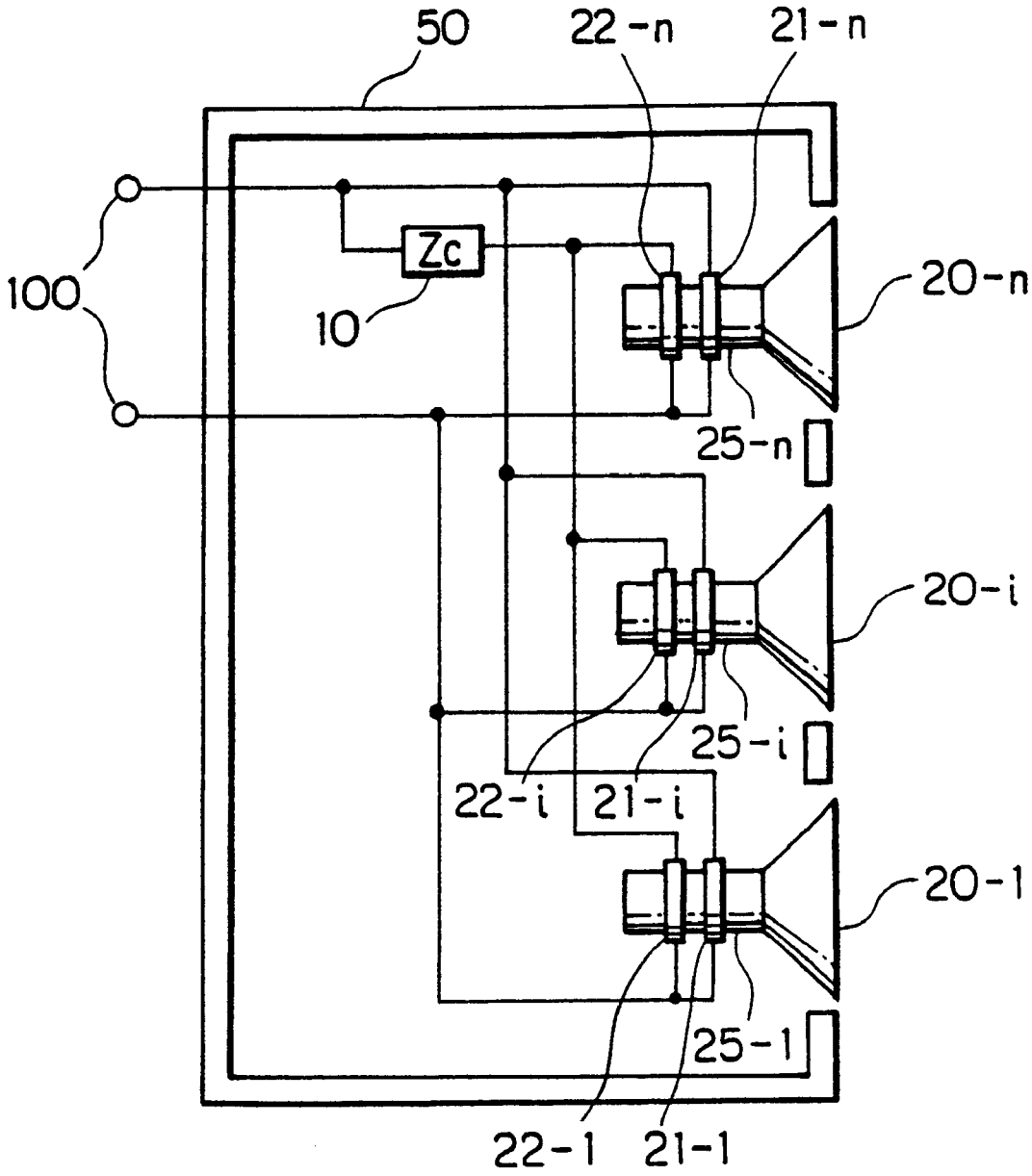
FIG. 1 is a structural block diagram showing an embodiment of the present invention using a closed type cabinet.

FIG. 1 is a structural diagram showing a first embodiment of the present invention.

In FIG. 1, reference numeral 10 denotes an impedance compensating circuit; 20-1, . . . , 20-i, . . . , 20-n, double-voice-coil speaker units of the same specification; 21-1, . . . , 21-i, 21-n, first voice coils; 22-1, . . . , 22-i, . . . , 22-n, second voice coils; 25-1, . . . , 25-i, . . . , 25-n, bobbins for fixing the voice coils; 50, a closed type cabinet; and 100, a signal input terminal to the speaker.

In this example, the plurality of double-voice-coil units are connected in parallel with each other in such a manner that the first voice coils 21-1, . . . , 21-i, . . . , 21-n are connected to each other at the same polarities, and the second voice coils 22-1, . . . , 22-i, . . . , 22-n are connected to each other at the same polarities. Also, the second voice coils 22-1, . . . , 22-i, . . . , 22-n as connected in parallel are connected in series to an impedance correcting circuit 10.

It should be noted that the closed type cabinet is directed to the cabinet 50 having a structure where a rear space of the speaker unit to be attached is closed from the exterior.

Then, the operation of the above speaker system will be described with reference to FIG. 2.

Figure 2:
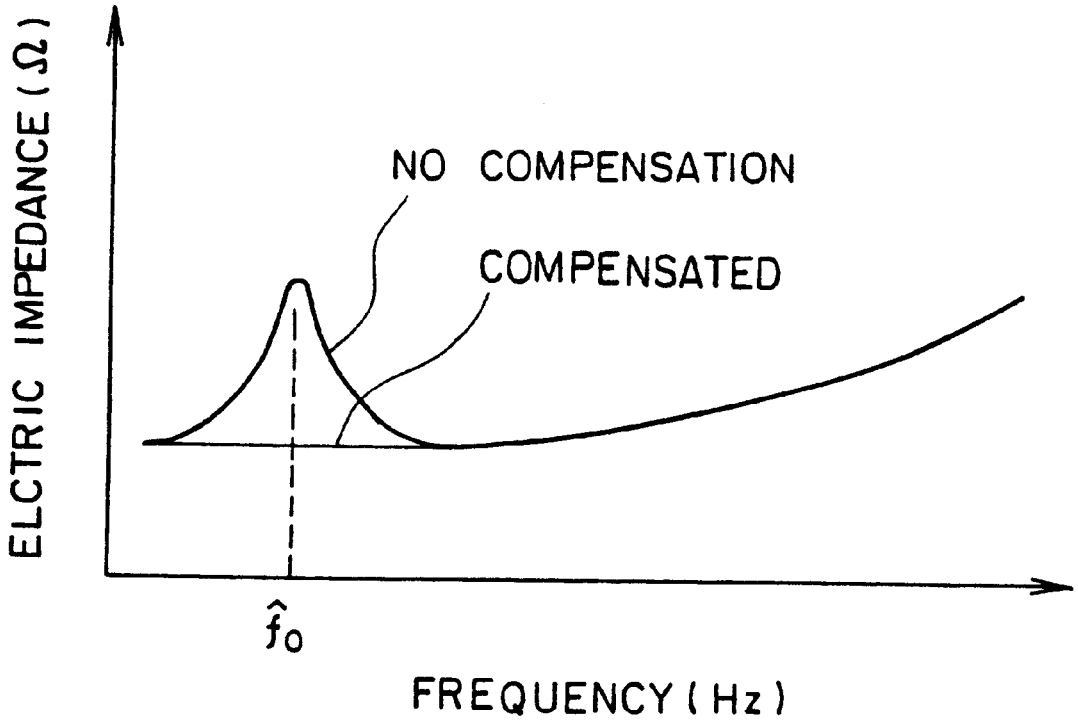
FIG. 2 is a graph representing an electric impedance characteristic of the closed type speaker system, that is, a characteristic comparison between a case where an impedance compensating circuit is used and a case where no impedance compensating circuit is used.

The electric impedance of the conventional closed type speaker system generally has a peak in the vicinity of a minimum resonance frequency hat $f_0$ as shown in FIG. 2. This characteristic corresponds to a case where only the first voice coils of the plural units having the same specification and connected in parallel in the structure shown in FIG. 1 are driven, and the electric impedance caused by the speaker units 20-1, . . . , 20-i, . . . , 20-n has a peak in the vicinity of the minimum resonance frequency hat $f_0$ in the case where the plural units are driven as in the case where a single unit is used. Therefore, a current as inputted is reduced more as the impedance rises, to thereby deteriorate the efficiency of a sound radiated from the speaker.

Under the above circumstance, in order to prevent the deterioration of the efficiency, the impedance compensating circuit 10 that makes the resistance of the electric impedance of the speaker system constant is added in series to the second voice coils of the plural units which are connected in parallel.

Figure 3:
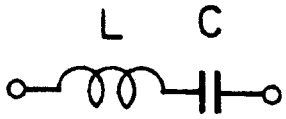
FIG. 3 is a circuit structural diagram showing one example of the impedance compensating circuit.

In this example, a value of the impedance compensating circuit 10 is determined so that the electric impedance as the speaker system has a constant resistance in the case where the closed type cabinet is used. That is, since the electric impedance caused by only the first voice coils of the plural units as connected in parallel is represented in FIG. 2, the value of the impedance compensating circuit 10 is selected so as to cancel a peak of this characteristic. This circuit is generally represented by the series circuit consisting of an inductance L and a capacitance C as shown in FIG. 3 and represented by the following mathematical expression.

$$Z_c = j\omega L + \frac{1}{j\omega C} \tag{1}$$

In this example, although the respective element constants of the impedance compensating circuit 10 depend on the dimensions of the double-voice-coil units and the closed type cabinet 50, the conditions for perfectly making the resistance of the electric impedance as the speaker system constant is determined univocally. In the case of using the closed type cabinet, assuming that:

$\omega_0$ is a resonance angular frequency of the double-voice-coil speaker unit viewed from the first voice coils;

$m_0$ is an equivalent mass of the double-voice-coil speaker unit viewed from the first voice coils;

$C_0$ is an equivalent mechanical compliance of the double-voice-coil speaker unit viewed from the first voice coils;

$Q_0$ is an electric sharpness of the double-voice-coil speaker unit viewed from the first voice coils;

$Q_m$ is a mechanical sharpness of the double-voice-coil speaker unit viewed from the first voice coils;

$\alpha$ is a ratio of the force factor of the second voice coil to the first voice coil;

$C_b$ is an air compliance caused by a volume within the closed type cabinet viewed from a single unit as disposed;

$r_b$ is an equivalent mechanical resistance caused by a volume within the closed type cabinet viewed from a single unit as disposed;

$R_{v1}$ is a resistance of the first voice coils; and n is the number of the double-voice-coil unit, then the resistance $R_{v2}$ of the second voice coils, the inductance L of the impedance compensating circuit 10 and the capacitance C are obtained from the following expressions.

$$R_{V2} = R_{V1}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\} \tag{2}$$

-continued $$L = \frac{R_{V1}}{\omega_0}\left(\frac{Q_0 Q_m}{Q_m - Q_0}\right) \tag{3}$$

$$C = \frac{1}{R_{V1}\omega_0}\left(\frac{Q_m - Q_0}{Q_0 Q_m}\right)\frac{\gamma_b}{n + \gamma_b} \tag{4}$$

wherein $\gamma_b$ and $Q_b$ are as follows.

$$\gamma_b = \frac{C_b}{C_0} \tag{5}$$

$$Q_b = \frac{\omega_0 m_0}{r_b} \tag{6}$$

Figure 4:
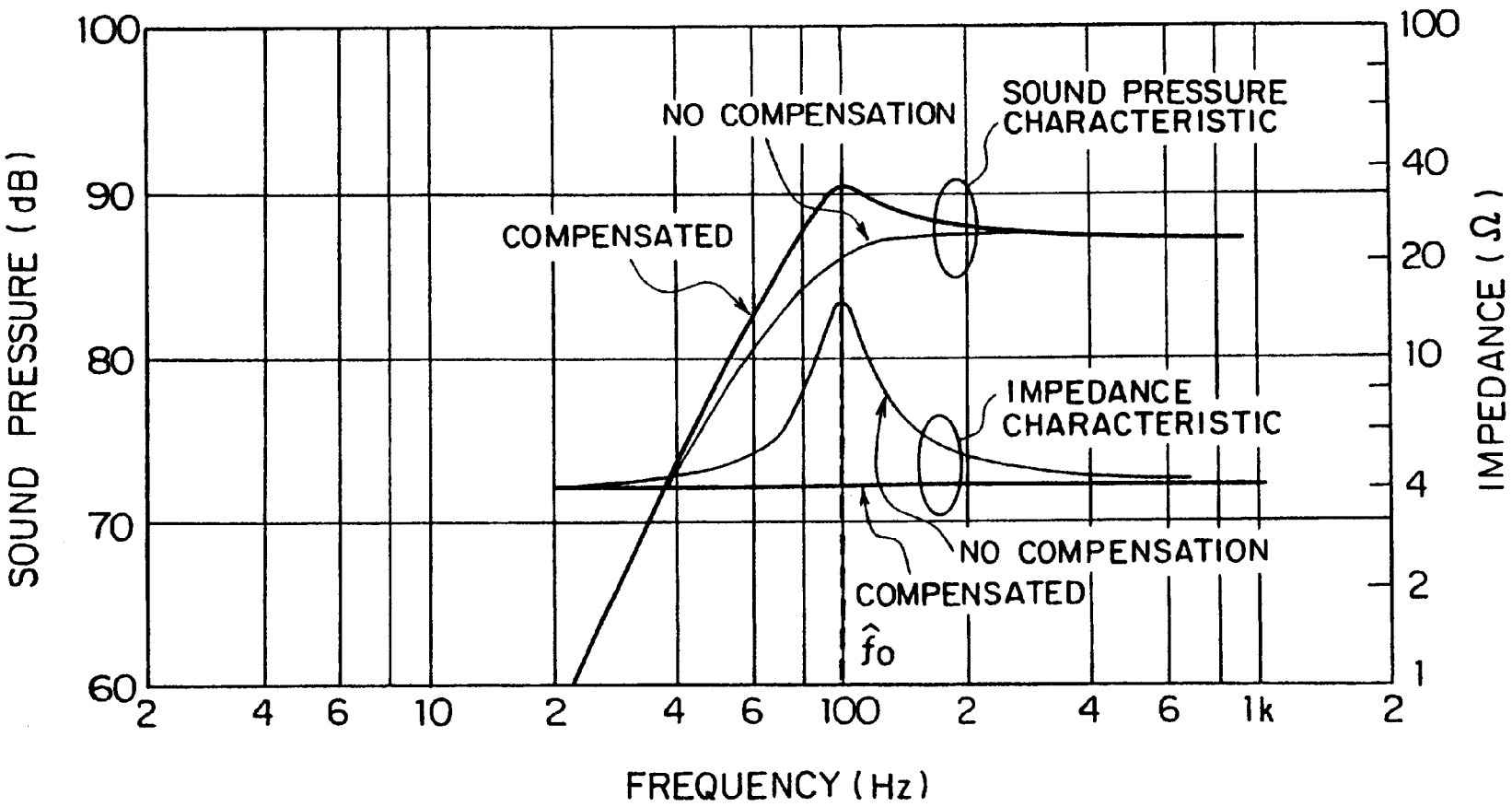
FIG. 4 is a graph representing a characteristic comparison of a change in a sound pressure characteristic and an electric impedance characteristic due to the presence/absence of a compensating element in a low sound region.
Figure 5:
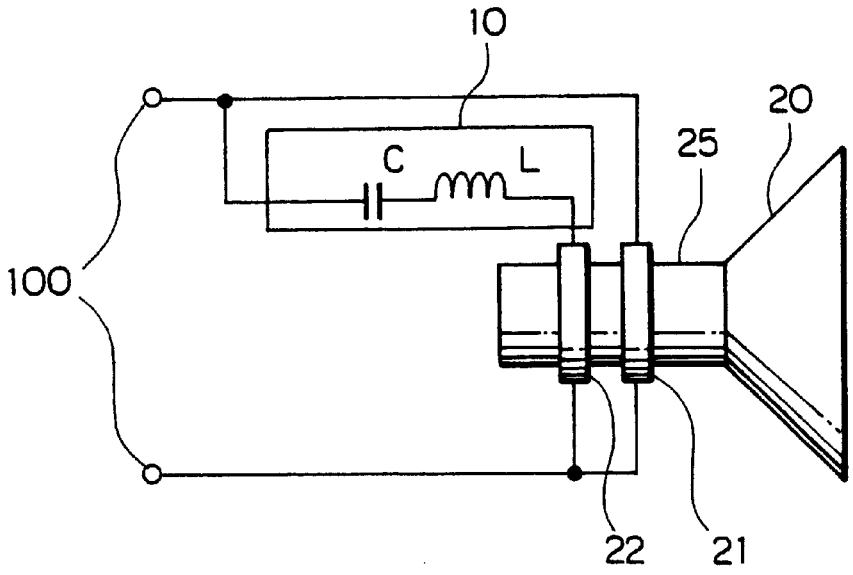
FIG. 5 is a structural block diagram showing a conventional speaker using a double voice coil.
Figure 6:
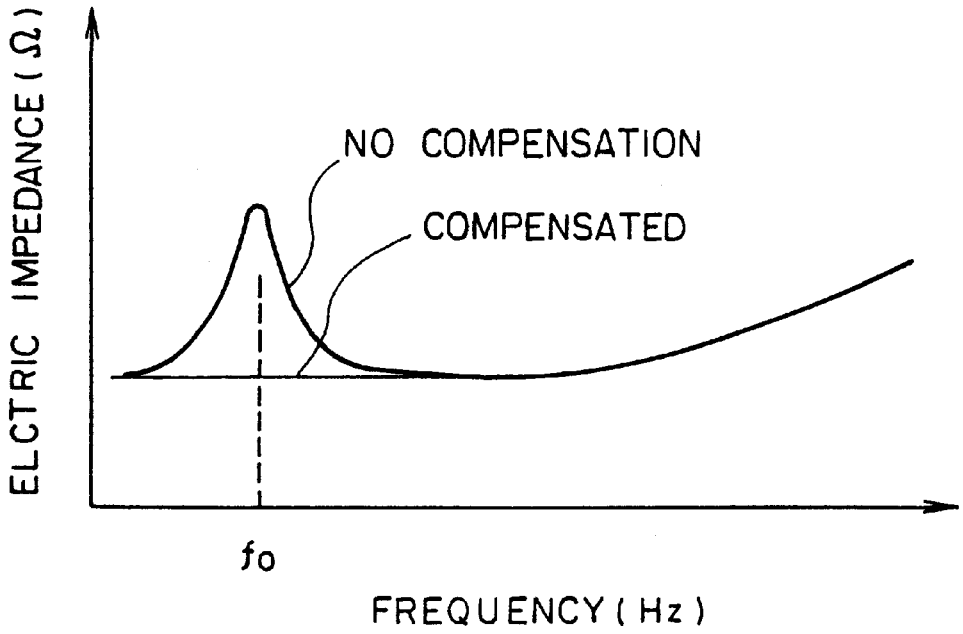
FIG. 6 is a graph representing an electric impedance characteristic of a conventional speaker using a double voice coil, that is, a comparison between a case where the compensating circuit is used and a case where no compensating circuit is used.
Figure 7:
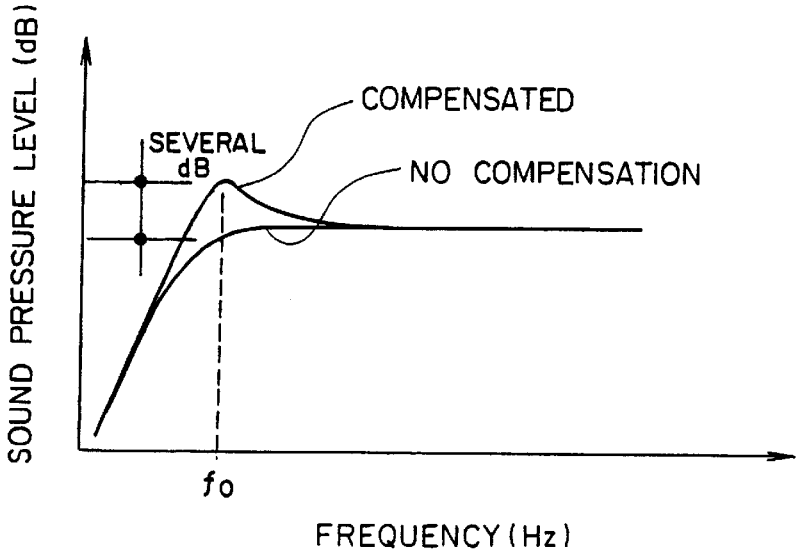
FIG. 7 is a graph representing a sound pressure characteristic of a conventional speaker using a double voice coil, that is, a comparison between a case where the compensating circuit is used and a case where no compensating circuit is used.
Figure 8:
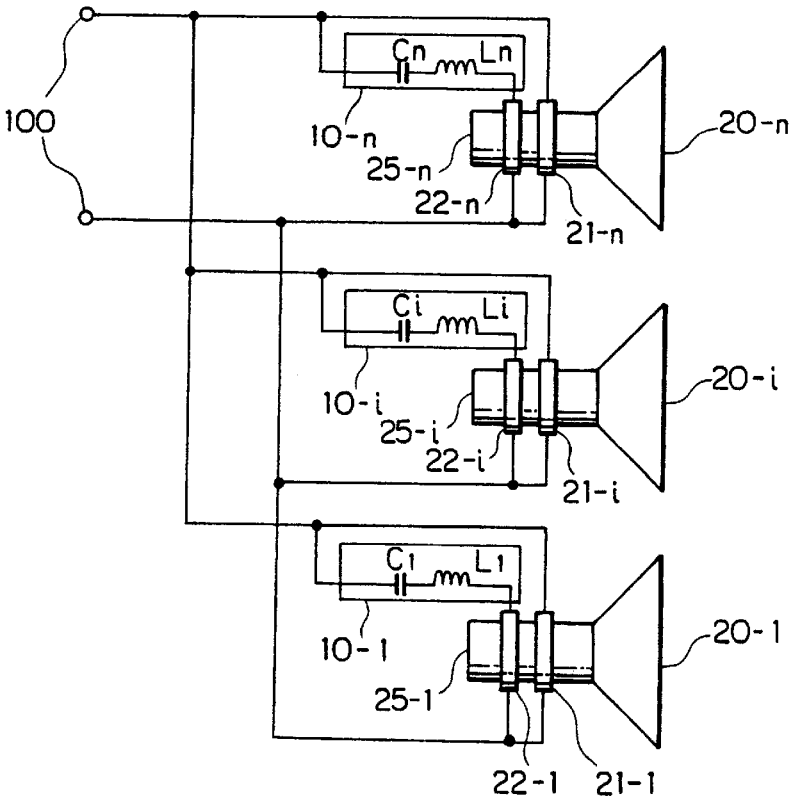
FIG. 8 is a block diagram showing the structure of the conventional speaker using a plurality of double-voice-coil units.

FIG. 4 shows a calculation result obtained by comparison of a change in the sound pressure level characteristic and the electric impedance characteristic between the presence and absence of the compensating device in a low sound region in the case of using two double-voice-coil speaker units of the same specification.

As is apparent from FIG. 4, the resistance of the impedance is made constant by the impedance compensating circuit 10, and the sound pressure level rises in the vicinity of the minimum resonance frequency hat $f_0$.

As was described above, the speaker system using the double-voice-coil speaker units according to the present invention includes the plurality of double-voice-coil speaker units fitted to the closed type cabinet and connected in parallel with each other so that the first voice coils are connected to each other at the same polarities, and the second voice coils are connected to each other at the same polarities, and the single impedance compensating circuit is connected in series to the second voice coils for making the input impedance as said speaker system constant. With this structure, an input signal is constantly supplied to the speaker system at all times, thereby improving the sound radiation efficiency in the vicinity of the minimum resonance frequency of the closed type speaker system. Also, there can be obtained an advantage that the system can be inexpensively provided even if a plurality of units are used.

Also, since the impedance compensating circuit is made up of a series circuit that includes the inductance L and the capacitance, the constant is selected so as to cancel the peak of the electric impedance characteristic caused by only the first voice coils of the plural units connected in parallel, thereby making the electric impedance constant.

Further, the double-voice-coil speaker unit is designed so that the resistance $R_{v2}$ of the second voice coils and the element constants L, C of the impedance compensating circuit satisfy the relations indicated by the expressions (2) to (4), under the condition where the second voice coils are opened, assuming that a resonance angular frequency viewed from the first voice coil is $\omega_0$, an equivalent mass is $m_0$, a compliance is $C_0$, an electric sharpness is $Q_0$, a mechanical sharpness is $Q_m$, a ratio of the force factor of the second voice coil to the first voice coil is $\alpha$, an air compliance due to a volume within the closed type cabinet viewed from a single unit as disposed is $C_b$, a mechanical resistance is $r_b$, an inductance of the impedance compensating circuit is L, a capacitance is C, the resistances of the first and second voice coils are $R_{v1}$ and $R_{v2}$, respectively, and the number of the double-voice-coil speaker units as used is n. With this structure, the resistance of the electric impedance can be perfectly made constant.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A speaker system, comprising:

a closed type cabinet in which a rear space relative to a speaker disposed face is closed;

a plurality of double-voice-coil speaker units, each having a first voice coil and a second voice coil and being fixed to said closed type cabinet, each said first voice coil and second voice coil having a connection of a first polarity and a connection of a second polarity; and an impedance compensating circuit that makes the impedance of said speaker system constant; wherein the first voice coils of said plurality of double-voice-coil speaker units are connected in parallel to each other so that the respective same polarities are connected to each other, the second voice coils of said plurality of double-voice-coil speaker units are connected in parallel to each other so that the respective same polarities are connected to each other, an input signal is directly applied to said first voice coils of said plurality of double-voice-coil speaker units, and the input signal is applied to said second voice coils of said plurality of double-voice-coil speaker units through said impedance compensating circuit, said impedance compensating circuit is made up of a series circuit that includes an inductor and a capacitor, and said double-voice-coil speaker units are designed so that a resistance $R_{v2}$ of said second voice coils and element constants L, C of said impedance compensating circuit satisfy the following expressions, under the condition that said second voice coils are opened, assuming that a resonance angular frequency is $\omega_o$, an equivalent mass is $m_o$, a mechanical sharpness is $Q_m$, a ratio of the force factor of said second voice coil to said first voice coil is $\alpha$, an air compliance due to a volume within said closed type cabinet viewed from a single unit as disposed is $C_b$, a mechanical resistance is $r_b$, an inductance of said impedance compensating circuit is L, a capacitance of said impedance compensating circuit is C, the resistances of said first and second voice coils are $R_{v1}$ and $R_{v2}$, respectively, and the number of said plurality double-voice-coil speaker units is n:

$$R_{V2} = R_{V1}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\};$$

$$L = \frac{R_{V1}}{\omega_0}\left(\frac{Q_0 Q_m}{Q_m - Q_0}\right); \text{ and}$$

$$C = \frac{1}{R_{V1}\omega_0}\left(\frac{Q_m - Q_0}{Q_0 Q_m}\right)\frac{\gamma_b}{n + \gamma_b}, \text{ where}$$

$$\gamma_b = \frac{C_b}{C_0} \quad Q_b = \frac{\omega_0 m_0}{r_b}.$$

2. The speaker system as claimed in claim 1, wherein said plurality of double-voice-coil speaker units have the same specifications.

* * * * *